US006591727B1

(12) United States Patent
Purcell et al.

(10) Patent No.: US 6,591,727 B1
(45) Date of Patent: Jul. 15, 2003

(54) RECESSED APPARATUS FOR CUTTING AND DISPENSING A WEB OF ROLLED MATERIAL

(75) Inventors: Ricky W. Purcell, Alpharetta, GA (US); David W. Kapiloff, Gainesville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/513,548

(22) Filed: Feb. 25, 2000

(51) Int. Cl.[7] ..... B65H 19/10
(52) U.S. Cl. ..... 83/650; 225/34; 225/42
(58) Field of Search ..... 225/39, 42, 41, 225/46, 34; 83/650, 649

(56) References Cited

U.S. PATENT DOCUMENTS

| | | | | | |
|---|---|---|---|---|---|
| 886,092 | A | * | 4/1908 | Tily et al. | 225/16 |
| 1,693,338 | A | * | 11/1928 | Honschopp | 225/41 X |
| 2,121,346 | A | * | 6/1938 | Harvey | 225/46 X |
| 2,174,190 | A | * | 9/1939 | Hunt | 225/39 X |
| 2,626,761 | A | * | 1/1953 | Simpson et al. | 225/42 |
| 2,668,022 | A | * | 2/1954 | Fairfield | 225/41 X |
| 2,913,299 | A | * | 11/1959 | Clift, Jr. | 225/39 X |
| 2,957,738 | A | * | 10/1960 | Marcuse | 225/39 X |
| 3,494,518 | A | * | 2/1970 | Goss | 225/34 |
| 3,697,146 | A | | 10/1972 | Boisen | |
| 3,713,569 | A | | 1/1973 | Dashnier, et al. | |
| 4,122,738 | A | | 10/1978 | Granger | |
| 4,206,858 | A | | 6/1980 | DeLuca et al. | |
| 4,213,363 | A | | 7/1980 | Granger | |
| 4,307,639 | A | | 12/1981 | DeLuca | |
| 4,362,278 | A | | 12/1982 | Hopkinson | |
| 4,404,880 | A | | 9/1983 | DeLuca | |
| 4,422,585 | A | * | 12/1983 | Schultz et al. | 225/46 X |
| 4,432,261 | A | | 2/1984 | DeLuca | |
| 4,441,392 | A | | 4/1984 | DeLuca | |
| 4,444,359 | A | * | 4/1984 | Butler | 242/598.6 |
| 4,552,315 | A | | 11/1985 | Granger | |
| 4,611,768 | A | | 9/1986 | Voss et al. | |
| 4,621,755 | A | | 11/1986 | Granger | |
| 4,634,033 | A | | 1/1987 | Lloyd | |
| 4,635,837 | A | | 1/1987 | Granger | |
| 4,712,461 | A | | 12/1987 | Rasmussen | |
| D293,750 | S | | 1/1988 | Leotta | |
| 4,732,306 | A | | 3/1988 | Jesperson | |

(List continued on next page.)

OTHER PUBLICATIONS

U.S. Patent Application entitled "Paper Towel Dispenser", USSN 29/122/634, filed May 1, 2000, KCX–190–D (Kimberly–Clark Reference No. 15466).

*Primary Examiner*—Charles Goodman
(74) *Attorney, Agent, or Firm*—Dority & Manning

(57) ABSTRACT

A dispenser for dispensing and cutting a measured amount from a web of roll material includes a housing and a roll carrier disposed within the housing to rotationally carry a first web of roll material. A rotatable drum is disposed in the housing proximate to the roll carrier. The roll carrier is biased towards the drum so that a roll carried by the roll carrier is urged towards the drum and the web material is frictionally engaged against the drum to rotate the drum upon a consumer pulling on the free end of the web material. A cutting device extends longitudinally along and is disposed at least partially within the drum. The cutting device extends automatically from a retracted position to a cutting position upon the drum being rotated a constant predetermined amount by a consumer pulling on the free end of the web material. A stub roll carrier is disposed in the housing to rotationally carry a depleted second roll of material that is simultaneously dispensed with the first web of roll material. The stub roll carrier defines an axis of rotation that is behind a vertical plane through the first axis of rotation of the primary roll carrier.

17 Claims, 3 Drawing Sheets

U.S. PATENT DOCUMENTS 4,790,490 A 12/1988 Chakravorty
4,846,035 A 7/1989 Granger
4,960,248 A 10/1990 Bauer et al.
D312,179 S 11/1990 DeLuca et al.
D316,788 S 5/1991 Fischer et al.
5,048,386 A 9/1991 DeLuca et al.
5,078,033 A 1/1992 Formon
5,125,548 A * 6/1992 Perrin et al. ..... 225/39
5,135,147 A 8/1992 Granger
5,146,830 A 9/1992 Granger
5,161,723 A 11/1992 Wirtz-Odenthal
D332,023 S 12/1992 Campbell
5,205,454 A 4/1993 Schutz et al.
5,244,161 A 9/1993 Wirtz-Odenthal
5,257,711 A 11/1993 Wirtz-Odenthal
5,294,192 A 3/1994 Omdoll et al.
D346,519 S 5/1994 Krueger et al.
D347,135 S 5/1994 Morand
5,318,210 A 6/1994 Morand
5,335,811 A 8/1994 Morand
5,410,930 A 5/1995 DeLuca et al.
5,441,189 A 8/1995 Formon et al.
D363,628 S 10/1995 McCanless
5,549,218 A 8/1996 Asmussen
5,558,302 A 9/1996 Jesperson
5,630,526 A 5/1997 Moody
5,772,291 A 6/1998 Byrd et al.
D398,797 S 9/1998 Brandenburg et al.
5,836,862 A 11/1998 Granger
5,860,578 A * 1/1999 Laguna ..... 225/39 X
5,868,343 A 2/1999 Granger
5,904,316 A * 5/1999 Dunning et al. ..... 225/42 X
5,924,617 A 7/1999 LaCount et al.
5,937,718 A 8/1999 Granger
5,967,011 A 10/1999 Feldkamper et al.
5,975,456 A 11/1999 Bodkin et al.
5,979,062 A 11/1999 Prosan
5,979,284 A 11/1999 Granger
5,979,821 A 11/1999 LaCount et al.
6,012,674 A 1/2000 Leeuwenburg
6,027,002 A 2/2000 Granger
D426,412 S 6/2000 Cameron

* cited by examiner

RECESSED APPARATUS FOR CUTTING AND DISPENSING A WEB OF ROLLED MATERIAL

BACKGROUND OF THE INVENTION

The present invention relates to a dispenser for a roll of material, and particularly to a sanitary dispenser that automatically cuts and dispenses a measured amount of material upon a user grasping and pulling the tail end of the web.

A number of dispensing devices are well known in the art for dispensing and cutting webs of roll material, including paper toweling, paper products, and the like. In such dispensers, the processes of dispensing and cutting the web material are carried out automatically by pulling on the free or "tail" end of the web material that extends from the apparatus. The web material is engaged against a "rough" or friction enhancing surface of a feed drum and the action of pulling the web material causes the drum to rotate. The drum includes a drive mechanism and, after the initial pull on the web material by the user, the drum is driven a predetermined rotational degree to dispense a metered amount of the web material. The drum is equipped with a cutting tool, such as a bar, blade, or the like, which extends from a retracted position within the drum to an extended position once the drum reaches a predetermined rotational position to affect a cutting of the web material. Dispensing devices of this type are described in detail in U.S. Pat. Nos. 4,213,363; 4,635,837; 4,621,755; 4,846,035; and 4,122,738.

The dispensers described in the patents cited above are commonly referred to as "sanitary" dispensers because the user does not manually operate any portion of the drive or cutting mechanism. The user only touches the tail end of the web material that is dispensed and cut for that particular user.

A number of these conventional dispensers also incorporate an additional "stub" roll feature. When the primary roll of web material becomes depleted to a certain extent, it can be placed on a stub roll carrier so that a new primary roll may be loaded into the dispenser. The web material from the stub roll is then fed through the dispensing device with the web material from the primary roll and the two web materials are simultaneously dispensed until the stub roll is completely depleted. Thus, the user obtains two metered sheets or lengths of the web material until the stub roll is depleted. The stub rolls are thus utilized in their entirety and the user need not consecutively activate the dispenser to obtain additional sheets of web material. Dispensers of this type are well known in the art. Examples of such dispensers include a line of "No Touch" or "Hands Free" sanitary dispensers from Kimberly Clark Corporation referred to as SaniTouch® dispensers, the "No Touch" dispensers, and the "Hands-Free" dispensers. These commercial dispensers are well known and understood by those skilled in the art.

With the conventional dispensers, the stub roll carrier feature results in a relatively large housing that covers the internal components of the apparatus, particularly towards the bottom dispensing end. It has been the common practice to mount the stub roll carrier generally below and in front of the rotatable drum. The overall housing thus has a relatively "deep" cross sectional profile, particularly when the backside of the housing is mounted flush on a wall or other support member. The dispensing slot or opening is typically defined in the bottom and more towards the back of the housing. This is problematic in certain situations because a direct line of sight to the tail end of the web material extending out of the dispensing slot is blocked by the protruding front surface of the housing. This may result in dispensing defects with the conventional dispensers as users fail to grasp an appropriate area of the towel to successfully execute a dispense cycle due to lack of visual contact with the towel or web tail.

The present invention relates to an improvement in the conventional dispensers utilizing a stub roll carrier to reduce the number of dispensing defects.

SUMMARY OF THE INVENTION

Objects and advantages of the invention will be set forth in the following description, or may be learned from the description or through practice of the invention.

The present invention includes an apparatus for automatically dispensing and cutting measured amounts of material from a web of roll material. The invention utilizes the "sanitary" dispensing and cutting mechanisms of the conventional devices discussed in the BACKGROUND SECTION.

The apparatus includes a housing in which the internal components of the apparatus are disposed. A roll carrier is disposed within the housing to rotationally carry a primary or first web of roll material to be dispensed from the apparatus. The roll carrier defines a first axis of rotation for the first web of roll material. A rotatable feed drum is disposed within the housing proximate to the roll carrier. The roll carrier is biased towards the rotatable drum so that a roll of web material carried by the roll carrier is urged towards the drum. In this way, the web material is frictionally engaged against the drum so as to rotate the drum upon the "tail" or free end of the web material being pulled from the housing.

A cutting device extends longitudinally along and is operably disposed at least partially within the rotatable drum. This cutting device is configured to automatically extend from a retracted position within the drum to a cutting position beyond the drum upon the drum being rotated a constant predetermined amount by pulling the free end of the web material.

A stub roll carrier is disposed within the housing to rotationally carry a partially depleted second web of roll material. The second web of material is dispensed with the first web until the second web is exhausted. The stub roll carrier defines a second axis of rotation that is behind a vertical plane through the first axis of rotation with respect to a front side of the housing. In this way, the stub roll carrier is mounted within the housing behind the roll carrier for the primary web material and thus does not unnecessarily add to the depth of the apparatus with respect to a wall or other support frame upon which the apparatus is mounted.

In one embodiment, the stub roll carrier is mounted within the housing so that the second axis of rotation is above the first axis of rotation. To further reduce the depth or profile of the apparatus from the support wall, the housing may be configured for mounting at least partially within a recess defined in the wall. In this embodiment, the housing has a front portion that is exposed to view and a recess back portion that is recessed within the wall when the housing is mounted. In this embodiment, the stub roll carrier may be mounted at least partially within the back portion so that it does not contribute at all to the depth of the front portion. The front portion and back portion may be defined by a flange section that positions or mounts the front portion on the wall around the circumference of the recess.

Due to the beneficial positioning of the stub roll carrier, the housing may have a front surface having a forwardmost protruding section that is disposed proximate to the primary roll carrier. This forwardmost protruding section need only be sufficient enough to accommodate the diameter of the primary web of roll material. The front surface tapers rearwardly from the forwardmost protruding section towards a dispensing slot defined in the housing. In this manner, an unobstructed line of sight is provided for the user at an eye level about at the same height as the protruding section to the tail of the web material that extends from the dispensing slot. The user need not bend over or look under the housing in order to locate and grasp the tail end of the web material.

In order to further reduce the depth of the housing, the roll carrier and drum may be mounted on a frame member that is in turn mounted within the housing at an angle such that the roll carrier is tilted rearward and the drum is moved forward with respect to a vertical plane through the housing. This embodiment is particularly suited for the recessed wall configuration in that the roll carrier can thus be moved at least partially into the back portion of the housing. Thus, the forwardmost projection of the housing can be further reduced since the first roll of web material is moved at least partially into the back portion of the housing that resides within the wall recess.

The invention will be explained in greater detail below through use of the appended Figures.

DETAILED DESCRIPTION

Figure 1:
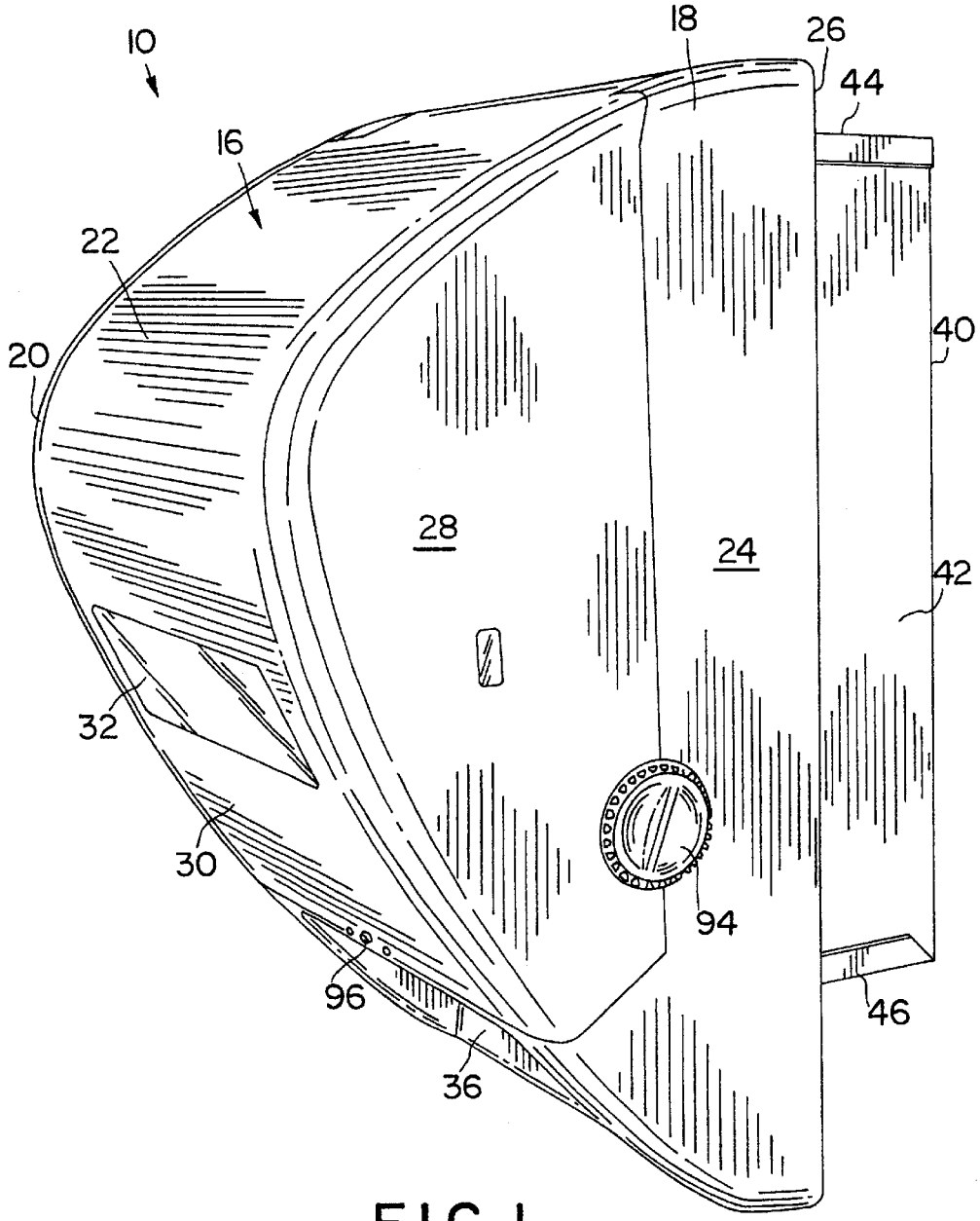
FIG. 1 is a perspective view of an embodiment of a dispenser according to the invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

An embodiment of the apparatus according to the present invention is indicated as a dispenser 10 in the Figures. Dispenser 10 is configured to dispense a primary web of roll material 12 that may comprise a standard eight-inch paper towel roll. Dispenser 10 is also configured to carry and dispense a "stub" roll of material 14, as will be discussed in greater detail below.

Referring to FIG. 1, dispenser 10 includes a housing 16. Housing 16 further comprises a front portion 18 and a back portion 40. A circumferential flange 26 separates the front portion 18 from the back portion 40. Back portion 40 may have a generally rectangular shape and include a top 44, sides 42, and a bottom 46. Back portion 40 is configured to fit into a recess or opening provided in a wall or other support structure. Flange 26 is configured so as to abut against the wall. Thus, it should be understood that when mounted to a wall or support structure, the only portion of dispenser 10 visible will be front portion 18. Thus, the profile or projection of the dispenser 10 relative to a wall or support structure is reduced by housing at least a portion of the internal components of the dispenser 10 within the back portion 40 and mounting the back portion 40 within a recess.

It should be appreciated that the dispensing apparatus 10 according to the invention is not limited in its construction by any.particular type of materials. For example, back portion 40 may comprise a sheet metal assembly and front portion 18 may comprise a plastic assembly.

Figure 2:
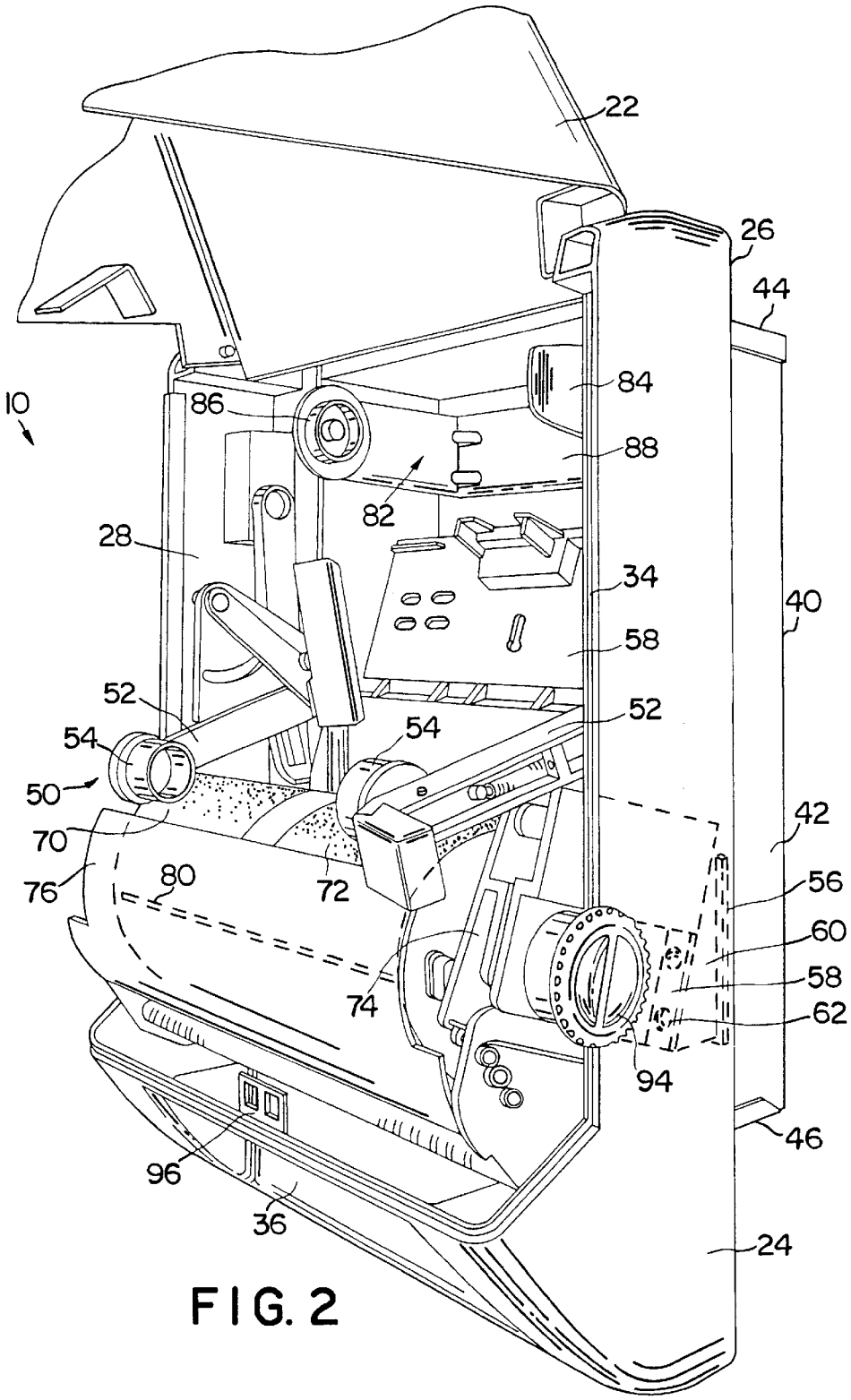
FIG. 2 is a perspective view of the internal components of the dispenser shown in FIG. 1.
Figure 3:
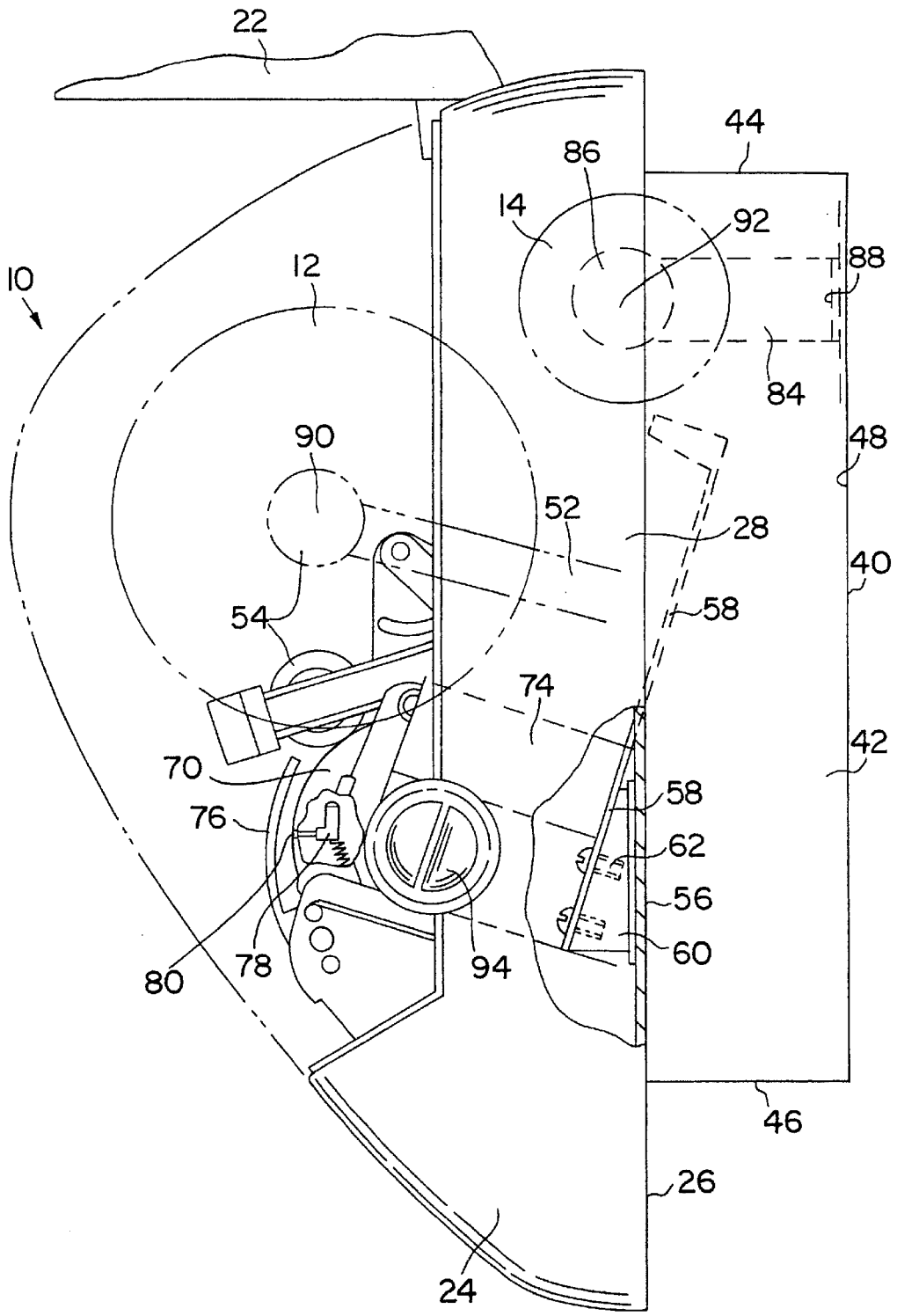
FIG. 3 is a cross-sectional side view of the dispenser with certain components indicated in phantom.

Front portion 18 includes a pivotal cover 22 that is latched by way of any conventional latch mechanism 96 to a stationary part 24. FIGS. 2 and 3 depict the cover 22 pivoted away from the stationary part 24 to provide access to the internal working components of the dispenser 10.

The front portion 18 also includes sides 28, a front surface 30, and an edge 34 against which the cover 22 abuts in a closed configuration of the components. A viewing window 32 is defined in the front surface 30 of cover 22. This window may allow an operator to visually check on the state of the first web of roll material 12. The window may also serve a decorative function in that a decorative strip or material may be placed behind the window. A dispensing slot 36 is defined in the front portion 18 in the bottommost portion of stationary member 24. Measured or metered sheets of the roll material are dispensed through this slot, as will be described in greater detail below.

Referring particularly to FIGS. 1 and 3, it can be seen that front portion 18 has a forwardmost projecting section 20. This section 20 has a size and shape so as to accommodate the primary or first web of roll material 12. The front surface 30 tapers inward and downward from the forwardmost projection 20 towards the dispensing slot 36. By providing a relatively slim and tapered profile, a consumer at eye level with the forwardmost projecting part 20 has a clear line of sight to the free or tail end of the web material extending out of the dispensing slot 36. Thus, the consumer can readily see and grasp the tail end for a subsequent dispensing operation and need not bend or reach blindly below the dispenser to feel and grasp the tail end of the web material.

The dispenser 10 is of the type described in the Background Section of this application wherein a measured or metered length of the roll material is automatically dispensed and cut upon the consumer grasping and pulling on the tail end of the material. In this regard, the working components, particularly the feed and cutting mechanisms, of the dispenser need not be described in great detail herein since such mechanisms are well known to those skilled in the art. The internal components illustrated in FIGS. 2 and 3 correspond essentially to the components illustrated and described in U.S. Pat. No. 4,621,755 to Granger. The '755 patent is thus incorporated herein by reference in its entirety for all purposes. The dispenser according to the invention may also incorporate the features of U.S. Pat. Nos. 4,635,837; 4,213,363; 4,846,035; and 4,122,738 all to Granger. All of these cited patents relate to mechanisms and components that may be used in the present invention for automatically dispensing and severing a length of web material upon a consumer grasping and pulling on the tail end of the material. All of the patents cited above are thus incorporated herein in their entirety for all purposes.

Briefly, a primary or first web of roll material 12 is carried by a primary roll carrier 50. Roll carrier 50 has opposite arms 52 and roll supports 54 extending inward from the arms 52. The arms 52 may be spring loaded towards a rotatable feed drum 70. The leading or free end of the web material passes around the outer circumferential surface of feed drum 70 and out through the dispensing slot 36. Drum 70 has a "rough" or frictional surface 72 and is rotatable so that upon a consumer grasping and pulling the tail end of the web material extending out of the dispensing slot 36, drum 70 is caused to rotate. A removable protective plate 76 is disposed in front of the feed drum 70. A tensioned eccentric device (not illustrated) is configured with feed drum 70 such that energy is developed and stored in a spring upon the initial rotation of the drum 70. A cam (not illustrated) is configured on feed drum 70 to rotate therewith. A cam follower is configured with the cam and the cutting device 78 disposed within the feed drum 70. When the tail end of the web material is pulled, the drum 70 rotates and the cam follower rolls on an upper profile of the cam in order to move the cutting device 78, out of the longitudinal slot 80 defined in the drum 70. The cutting device 78 penetrates into the material that is held taut on the surface of the feed drum 70 until the material is severed. The feed drum 70 is then relieved from the pulling tension and continues to turn due to the action of the eccentric and spring. The cam follower continues to follow along an opposite side of the cam thus ensuring that the cutting device 78 retracts through the longitudinal slot 80 into the interior of the feed drum 70. A shock absorber device, generally 74, stops the return rotation of the feed drum 70 so that the drum is then in position for a subsequent pulling and cutting operation. A manual rotation knob 94 is provided for manually advancing the drum 70 in the event of a jam or tear of the roll material within the housing. Again, the components and processes for feeding and cutting the web material is described in detail in the Granger patents cited above.

The dispenser 10 also incorporates a stub roll feature. Referring to FIGS. 2 and 3, a stub roll carrier 82 includes arms 84 and inwardly disposed roll supports 86. Arms 84 are connected to a base 88. As shown in FIG. 3, a partially depleted or "stub" roll is held by the stub roll carrier 82 and the roll material from this stub roll is fed simultaneously with the roll material from the primary roll 12 until the stub roll 14 is completely exhausted. In this regard, a consumer is dispensed two sheets of roll material in a single dispensing operation, as is commonly understood by those skilled in the art.

Referring again to FIGS. 2 and 3, it can be seen that the stub roll carrier 82 is mounted above and behind the primary roll carrier 50. A rotational axis 92 for the second or stub roll 14 is thus behind a vertical plane through a first axis of rotation 90 for the primary or first roll of web material 12 with respect to the front side of the housing 16. It may be preferred to dispose the stub roll carrier above a horizontal plane through the rotational axis 90 so that the stub roll does not interfere with the feeding and cutting mechanisms of the dispenser. In the embodiment illustrated, the base 88 of the stub roll carrier 82 is mounted directly against the back surface 48 of the back portion 40. In this regard, the stub roll carrier 82 is thus housed at least partially within the recess back portion 40 so as not to contribute to the "visible" profile or depth of the front portion 18. With conventional dispensers, the stub roll carrier was typically disposed below and generally in front of the primary roll carrier and thus added significantly to the depth or profile of the housing.

In order to further reduce the depth or profile of the front portion 18 of the housing 16, the feed drum 70 and primary roll carrier 50 are mounted to a frame member or support plate 58. This member or support plate 58 is angled or tilted with respect to a vertical plane such that the primary roll carrier 50 is disposed towards the back portion 40 of the housing. As can be particularly seen in FIG. 3, the support member or plate 58 extends at least partially into the back portion 40. Thus, the primary web of roll material 12 is drawn towards the back portion 40 of housing 16 and the forwardmost projection 20 of housing 16 can be appropriately reduced.

One method for tilting the support member or plate 58 is with an angle block 60 mounted onto a vertical housing frame member 56. Vertical member 56 may also define the flange member 26. The angle block 60 has an angled forward face upon which the support plate or member 58 is mounted, for example by way of screws 62. Applicants have found that a desired angle for angle block 60 is about 15° degrees from vertical.

The unique configuration of components for the dispenser as described herein offers a number of advantages. The depth or forwardmost projection of the dispenser with respect to the mounting wall is significantly reduced since at least a portion of the components are contained within the back recess portion of the housing. Also, the forwardmost part or projection of the visual housing is reduced by placement of the internal components rearward within the housing, particularly the stub roll carrier. With the present configuration, the forwardmost part or projection need only be configured to accommodate the size of the primary roll of web material. The front surface of the housing can thus be tapered or sloped directly to the dispensing slot so that the tail or free end of the web material is clearly visible to the consumer.

It should be appreciated by those skilled in the art that various modifications and variations can be made in the invention without departing from the scope or spirit of the invention. It is intended that the invention include such modifications and variations as come within the scope of the appended claims and their equivalents.

What is claimed is:

1. An apparatus having a streamlined housing for dispensing and cutting measured amounts of a web material, said apparatus being configured for mounting at least partially within a wall recess, comprising:

a housing configured for mounting at least partially within said wall recess, said housing comprising a front portion that is exposed to view and having a rear side mountable against a wall, the housing further comprising a back portion that is recessed with respect to the front portion, such that said back portion is disposed within said wall recess, when the housing is mounted;

a roll carrier disposed within said housing to rotationally carry a first web of roll material to be dispensed from said apparatus, said roll carrier defining a first axis of rotation for the first web of roll material;

a rotatable drum disposed within said housing proximate to said roll carrier, said roll carrier biased towards said rotatable drum so that the first web of roll material carried by said roll carrier is urged towards said drum and the first web of roll material is frictionally engaged against said drum so as to rotate the drum upon a free end of the first web of roll material being pulled from said housing;

a cutting device extending longitudinally along and operably disposed at least partially within said drum, said cutting device configured to automatically extend from a retracted position within said drum to a cutting position beyond said drum upon said drum being rotated a constant predetermined amount by pulling the free end of the first web of roll material; and a stub roll carrier disposed within said housing to rotationally carry a partially depleted second web of roll material that is capable of being dispensed simultaneously with the first web of roll material, the stub roll carrier fixedly mounted relative to said housing so as to remain stationary regardless of the size of the second web of roll material carried thereby and defining a fixed second axis of rotation for the partially depleted second web of roll material that is behind said first axis of rotation, said stub roll carrier comprising carrier arms having a length and disposed at least partially within the recessed back portion of the housing such that said stub roll carrier cannot carry a roll of web material as large as a maximum size of the first roll of web material carried by said roll carrier.

2. The apparatus as in claim 1, wherein a dispensing slot located on the front portion of the housing is capable of ejecting a paper tail of said first web of roll material.

3. The apparatus as in claim 1, wherein said housing further comprises a flange section separating said front portion from said back portion.

4. The apparatus as in claim 1, wherein said housing comprises a tapered front portion having a front surface with a forward most protruding section disposed proximate said roll carrier to accommodate the first web of roll material, said front portion tapering rearwardly and downwardly from said protruding section to a dispensing slot defined on the front portion of said housing.

5. The apparatus as in claim 1, wherein said roll carrier and said drum are mounted on a frame member that is mounted within said housing at an angle that deviates from vertical towards said recessed back portion of said housing.

6. The apparatus as in claim 5, wherein said stub roll carrier is mounted within said housing above said angled frame member to facilitate the location of the partially depleted second web of roll material within the back portion of the housing.

7. The apparatus as in claim 1, wherein said front portion further comprises a releasable cover member to provide access into said housing.

8. An apparatus for dispensing and cutting measured amounts of web material from a web of roll material, said apparatus comprising:

a housing configured for mounting at least partially within a wall recess, said housing comprising a front portion that is exposed to view and having a back mountable against a wall, the housing further comprising a back portion that is recessed with respect to the front portion, the back portion being disposed within the wall recess when said housing is mounted;

a roll carrier disposed within said housing to rotationally carry a first web of roll material to be dispensed from said apparatus, said roll carrier defining a first axis of rotation for the first web of roll material;

a rotatable drum disposed within said housing proximate to said roll carrier, said roll carrier biased towards said rotatable drum so that the roll carried by said roll carrier is urged towards said drum and the web material is frictionally engaged against said drum so as to rotate the drum upon a free end of the web material being pulled from said housing;

a cutting device extending longitudinally along and operably disposed at least partially within said drum, said cutting device configured to automatically extend from a retracted position within said drum to a cutting position beyond said drum upon said drum being rotated a constant predetermined amount by pulling the free end of the web material; and a stub roll carrier fixedly mounted with respect to said housing so as to remain stationary for any size web of roll material carried thereby and having side arms disposed at least partially within said back portion of said housing, said back portion of said housing having a size such that the roll of web material carried between said side arms of said stub roll carrier must have a diameter less than the diameter of a maximum size web of roll material carried by said roll carrier, said stub roll carrier defining a second axis of rotation for the second web of roll material that is positioned above said first axis of rotation and behind a vertical plane through said first axis of rotation with respect to a front side of said housing.

9. The apparatus of claim 8 further wherein said housing comprises a front surface having a forward most protruding section disposed proximate said roll carrier to accommodate the first web of roll material, said front surface tapering rearwardly from said protruding section to a dispensing slot defined on the front surface of said housing.

10. An apparatus, comprising:

a housing, the housing being configured for mounting at least partially within a wall, said housing comprising a front portion that is exposed to view and having a back mountable against the wall, the housing further comprising a back portion configured for disposition within the wall;

a roll carrier disposed within said housing to rotationally carry a first web of roll material to be dispensed from said apparatus, said roll carrier defining a first axis of rotation for the first web of roll material;

a rotatable drum disposed within said housing proximate to said roll carrier, said roll carrier biased towards said rotatable drum so that a first web of roll material carried by said roll carrier is urged towards said drum and the first web of roll material is frictionally engaged against said drum so as to rotate the drum upon a free end of the first web of roll material being pulled from said housing;

a cutting device extending longitudinally along and operably disposed at least partially within said drum, said cutting device configured to automatically extend from a retracted position within said drum to a cutting position beyond said drum upon said drum being rotated a constant predetermined amount by pulling the free end of the first web of roll material; and a stub roll carrier disposed within said housing to rotationally carry a partially depleted second web of roll material that is dispensed with the first web of roll material, the stub roll carrier defining a fixed second axis of rotation for the partially depleted second web of roll material, said second axis of rotation disposed above and behind said first axis of rotation; and wherein the roll carrier and said rotatable drum are stationarily mounted on a common frame member within the housing, said frame member provided at an angle that deviates from vertical and extends into said back portion of said housing.

11. The apparatus as in claim 10, wherein a dispensing slot located on the front portion of the housing is configured to eject a paper tail of said first web of roll material.

12. The apparatus as in claim 10, wherein said housing further comprises a flange section separating said front portion from said back portion.

13. The apparatus as in claim 10, wherein said housing comprises a front surface having a forward most protruding section disposed proximate said roll carrier to accommodate the first web of roll material, said front surface tapering rearwardly and downwardly from said protruding section to a dispensing slot defined on the front portion of said housing.

14. The apparatus as in claim 10, wherein said common frame member is at an angle of about 15 degrees from vertical, such that said roll carrier is oriented rearward of said drum.

15. The apparatus as in claim 10, wherein said common frame member is mounted against an angled block.

16. The apparatus as in claim 10, wherein said housing comprises a front surface having a forward most protruding section disposed proximate said roll carrier to accommodate the first web of roll material, said front surface tapering rearwardly from said protruding section to a dispensing slot defined in said housing.

17. The apparatus as in claim 10, wherein said front portion further comprises a releasable cover member which provides access into said housing.

* * * * *